United States Patent [19]

Martin

[11] 3,991,922

[45] Nov. 16, 1976

[54] ABRASIVE SHEET MEASURING AND CUTTING BOARD

[76] Inventor: Mervin B. Martin, Box 408 - R.D. 4, Coatesville, Pa. 19320

[22] Filed: Sept. 18, 1975

[21] Appl. No.: 614,767

[52] U.S. Cl. ..... 225/17; 225/81; 269/303; 269/319

[51] Int. Cl.[2] ..... B26F 3/02

[58] Field of Search.....225/6, 17, 18, 81, 91; 269/303, 319; 30/114, 124, 286, 289; 33/169 R; 83/467-468, 607

[56] References Cited

UNITED STATES PATENTS

| | | | |
|---|---|---|---|
| 492,354 | 2/1893 | Harrison | 225/81 |
| 1,172,127 | 2/1916 | Fritch | 83/468 X |
| 2,256,606 | 9/1941 | Blanc | 83/468 |
| 3,771,700 | 11/1973 | Garr | 225/91 X |
| 3,792,636 | 2/1974 | Pottern | 83/607 X |

*Primary Examiner*—Frank T. Yost

*Attorney, Agent, or Firm*—J. Gibson Semmes

[57] ABSTRACT

Cutting board for abrasive material sheets, wherein they may be simultaneously measured and cut to order, comprising portable base member, grooved at measured locations, transversely thereof, in coactive relationship to at least one upright guide and to means for severing the sheet.

1 Claim, 2 Drawing Figures

ABRASIVE SHEET MEASURING AND CUTTING BOARD

BACKGROUND OF THE INVENTION AND DESCRIPTION OF THE PRIOR ART:

Heretofore, no portable means have been provided for the measuring and cutting of abrasive sheet materials such as sandpaper, wherein the measurement positioning and cutting may be obtained simultaneously in one action. The closest patented art, appears to be found in Garr, U.S. Pat. No. 3,771,700; Johnson, U.S. Pat. No. 2,323,048; Kramer, U.S. Pat. No. 1,218,670 and Thain, U.S. Pat. No. 325,992. This general art relates to paper cutters, ticket cutters, wallpaper cutters and the like, and is devoid of the establishment of a serrated cutting edge which is associated a measured distance from coactive means for positioning the particular abrasive sheet material product.

Figure 1:
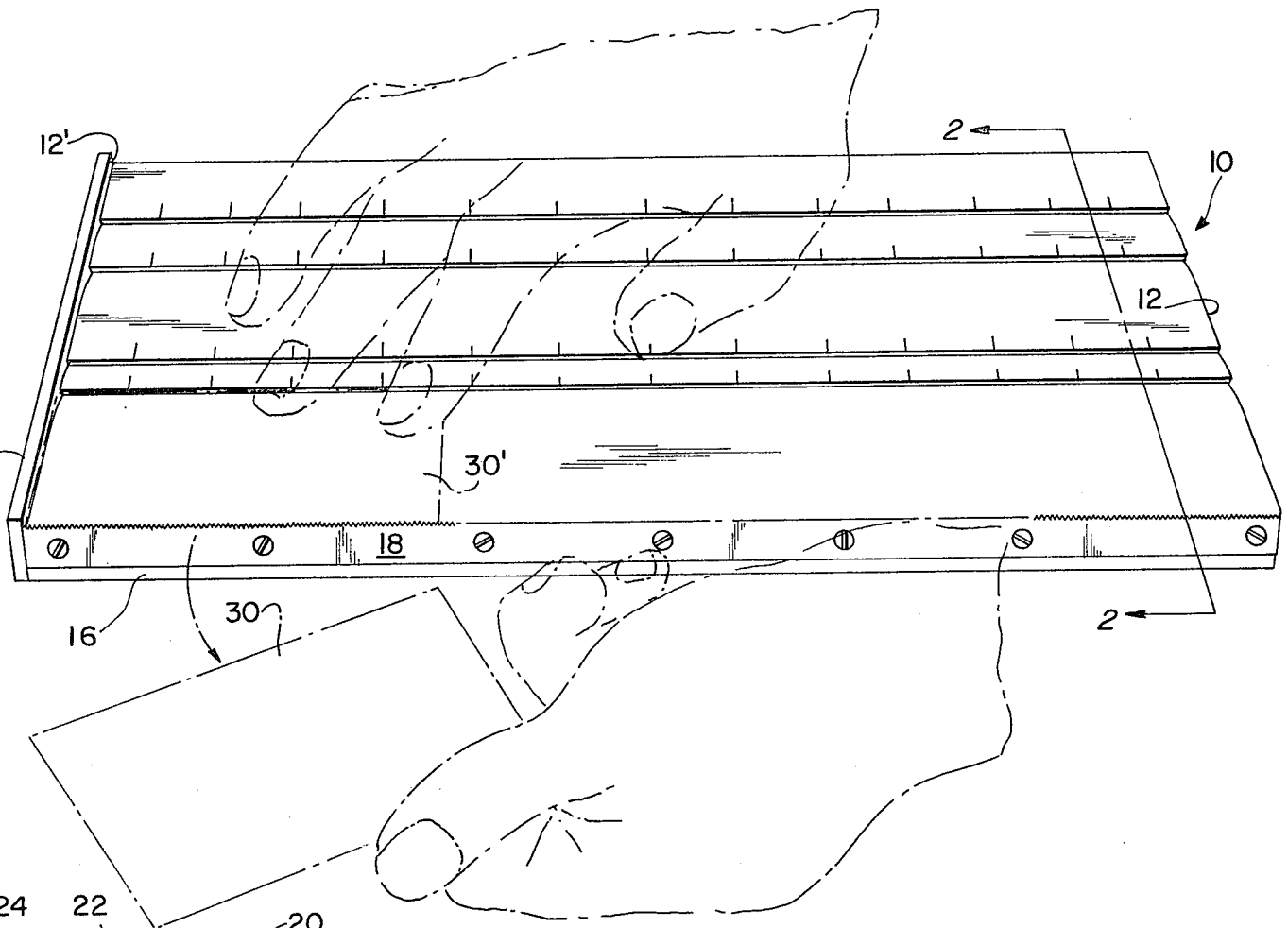
FIG. 1 is a view in perspective of invention.

Referring now to the drawings, and more particularly to FIG. 1, the abrasive sheet material measuring and cutting device is shown to comprise a portable, substantially rigid base member 10 having right hand and left hand ends 12—12′ respectively, and forward and rearward walls 16—16′ respectively. Secured to the left hand end 12′ is an upright 14, which said upright may be formed integrally with the base member. It is adapted to project a sufficient distance above the top surface of the base member 10 that it may provide a fore and aft extending abutment for use in connection with the top of the base member and the positioning grooves formed transversely thereof.

Figure 2:
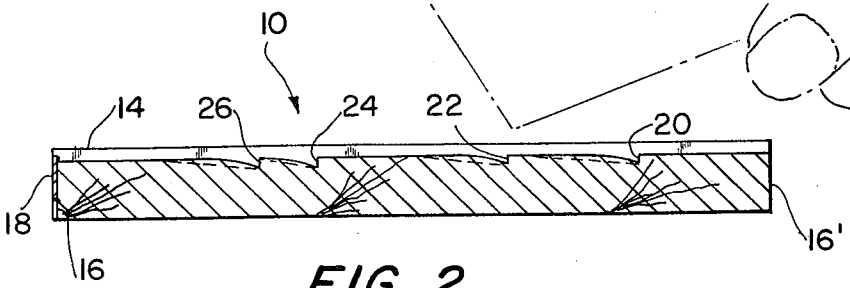
FIG. 2 is a vertical sectional view of the invention taken along the lines 2—2 of FIG. 1.

The grooves are designated respectively 20, 22, 24 and 26, said grooves extending transversely the width of the device from the right end 12 thereof, to the left hand end 12′. With reference to FIG. 2, it will be noted that the grooves each comprise in cross section a vertical back wall and a gently sloping front portion. The slope may be either curvalinear, as shown, or straight-line as indicated in phantom. The top of the respective back walls are coplanar from the rear of the base member 16′ to the front 16, thereof.

Secured to the front 16 of the base member is a serrated cutting bar 18, the uppermost portion of which projects sufficiently for the teeth thereof to satisfactorily perform in the cutting function, hereinafter described. It will be appreciated that the cutter 18 may also be comprised of an integral extension of the base member.

The relationship between upright 14, grooves 20–26 inclusive and cutter 18 is critical to the invention. For example, the measured distances between these elements is such as to permit the automatic sizing of the sheets, depending upon how they may be set, prior to cutting. The groove 26 will readily accommodate a sheet for cutting to a size 2¾ inches by 2½ inches; the groove 24 a sheet 4½ × 11 inches or 4½ × 2¾ inches; the groove 22, a sheet 4½ inches × 11 inches or 4½ inches × 5½inches; the groove 20, a sheet of size 4½ × 5½ inches or 5½ × 9 inches, and so on, depending upon the requirement and preselected positioning of the grooves, relative to the cutter.

Utilization of the device may be undertaken as follows. The rigid base member may be placed on a fixed and solid surface as, for example, a work bench or table, preferably adjacent the edge thereof. Secondly, the abrasive material sheet such as sandpaper which is to be measured and cut is set so that its rearward edge to be measured is placed in appropriate groove 20–26 inclusive, measuring the so-called depth thereof from the cutting edge to the selected groove. Ideally, the sandpaper or other abrasive sheet material is placed so that its left-most edge is abutting the upright 14, whereby the rearward and the lefthand edges of the sandpaper will be confined on two sides against displacement. As indicated, the upper hand of the user anchors the sandpaper in position while the other hand forces the paper against the serrated edge to cut a portion, leaving the desired size available for utilization without further trimming. This is identified as the portion 30′. That portion which has been taken away, namely 30, may be reinserted for recutting or stored for reuse.

Whereas the invention has been described with reference to a solid base plate and affixed abutment and cutter elements, the entire device may comprise an integral, formed as by molding of a rigid plastic substance.

I claim:

1. Portable abrasive sheet measuring and cutting device comprising:

A. substantially rectangular, elongate base member havng side ends and forward and rearward ends, said base member defining plural grooves transversely of the side ends thereof, each said groove being set parallel to the other, discrete distances in depth, relative to the forward and rearward ends of the base member; said grooves in vertical cross-section defining a declining front wall from the forward-most portion thereof to the bottom and a substantially vertically extending rearward wall the topmost of which is coplanar with the base member top defining a first abutment means for an abrasive sheet;

B. a serrated, abrasive sheet cutter, contiguous the forward edge of the base member, said cutter projecting above the plane of the base member and being parallel to the said respective grooves thereof;

C. a second abrasive sheet abutment on one side end and projecting above the plane of the base member, said second abutment being disposed normal to said first abutment means and said cutter and being coextensive with the forward and rearward ends thereof, whereby to confine with said grooves an abrasive worksheet on two sides thereof, a measured distance in depth from the cutter.

* * * * *